United States Patent [19]

Anbo et al.

[11] Patent Number: 4,758,182

[45] Date of Patent: Jul. 19, 1988

[54] ELECTRIC CONNECTOR

[75] Inventors: Tsugio Anbo; Katsuji Shimazawa; Yukifumi Machida, all of Tokyo, Japan

[73] Assignee: Shinagawa Jidosha Densen Co. Ltd., Tokyo, Japan

[21] Appl. No.: 919,701

[22] Filed: Oct. 16, 1986

[51] Int. Cl.[4] ..... H01R 13/40

[52] U.S. Cl. ..... 439/592; 439/211; 439/586; 439/598

[58] Field of Search ..... 339/59-63, 339/94; 439/586-589, 592, 593, 598, 271

[56] References Cited

U.S. PATENT DOCUMENTS

| | | | |
|---|---|---|---|
| 4,583,805 | 4/1986 | Mantlik | 339/59 R |
| 4,614,390 | 9/1986 | Baker | 339/59 R |
| 4,710,135 | 12/1987 | Asyama et al. | 439/598 |

*Primary Examiner*—Gil Weidenfeld
*Assistant Examiner*—Paula A. Austin
*Attorney, Agent, or Firm*—James W. Hellwege

[57] ABSTRACT

An electric connector including a housing made of resin and having a plurality of cavities for receiving a plurality of terminals and a terminal retaining member made of resin and having a plurality of holes. When a rear portion of the housing is inserted into an opening formed in a front portion of the terminal retaining member, the housing and terminal retaining member are preliminarily coupled with each other in a first coupling mode in which the holes of the terminal retaining member are aligned with the cavities of the housing. After the terminals having electric wires connected thereto have been inserted into the cavities through the holes, the terminal retaining member is shifted in a direction perpendicular to a direction in which the terminals are inserted and then is further moved toward the housing to attain a second coupling mode. In the second coupling mode the terminals are engaged with portions of the terminal retaining member to prevent the terminals from being removed out of the housing.

13 Claims, 10 Drawing Sheets

ELECTRIC CONNECTOR

BACKGROUND OF THE INVENTION

Field of the Invention and Related Art Statement

The present invention relates to an electric connector comprising a housing made of electrically insulating material and having a plurality of cavities for receiving a plurality of terminals each having an electric wire connected thereto, and a terminal retaining member made of electrically insulating material and having a plurality of holes through which the electrical wires are extended outwardly, said terminal retaining member being detachably coupled with a rear end of the housing.

In a known electric connector, in order to prevent terminals from being removed from the connector the terminal has a resilient locking tongue formed integrally therewith and the housing has a projection formed on an inner surface of each cavity. When the terminal is inserted into the cavity of the housing, the resilient locking tongue is passed beyond the projection. After the terminal has been inserted into the cavity, the locking tongue is engaged with the projection so that the terminal is retained in the cavity. However, in the known electric connector, the locking tongue might be bent or deformed permanently during the assembling and handling, and thus the engagement between the locking tongue and the projection might be insufficient and the terminal might be removed from the housing. In order to avoid such a drawback, there has been proposed an electric connector in which after terminals have been inserted into cavities of the housing, a terminal retaining member is detachably secured to a rear end of the housing. In case of securing the terminal retaining member to the housing, the wires connected to respective terminals contained in the housing have to be inserted into respective slits which are formed in an end surface of the terminal retaining member in a comb-shape. After the terminal retaining member has been coupled with the housing, the terminal could not be removed from the housing, because rear ends of the terminals are engaged with finger-like edges defining the slits. However, in such a known connector, an operation for inserting the wires into the slits of the terminal retaining member is very cumbersome and time consuming, because the wires must be inserted into corresponding slits. Therefore, the cost of assembling the known connector is liable to be quite expensive.

SUMMARY OF THE INVENTION

The present invention has for its object to provide a novel and useful electric connector which can be assembled in an easy and inexpensive manner, while terminals connected to wires can be positively prevented from being removed from the housing.

It is another object of the invention to provide an electric connector in which terminals each having respective wires connected thereto are inserted into respective cavities formed in a housing after a terminal retaining member has been temporarily coupled with the housing, and after all the terminals have been inserted into the cavities of the housing, the terminal retaining member is shifted in a direction perpendicular to a direction in which the terminals are inserted so as to couple the housing and terminal retaining member firmly with each other, while in the coupled condition the terminals cannot be removed from the housing due to the engagement of the terminals with the terminal retaining member.

According to the invention, an electric connector comprises a housing made of synthetic resin and having at least one cavity for receiving a terminal having an electric wire connected thereto and at least one retaining portion formed on an inner surface of the cavity;

a terminal retaining member made of synthetic resin and having at least one hole through which said terminal can be passed;

a first coupling means for coupling said housing and terminal retaining member with each other in a first coupling mode in which the hole of the terminal retaining member is aligned with the cavity of the housing and the terminal having the electric wire connected thereto can be inserted into the cavity through the hole, in said first coupling mode said retaining projection being engaged with a portion of the terminal; and a second coupling means for coupling the housing and terminal retaining member with each other in a second coupling mode in which the terminal retaining member is shifted with respect to the housing at least in a direction perpendicular to a direction in which the terminal is inserted into the cavity, and the terminal can not be removed from the cavity by an engagement between the terminal and a portion of the terminal retaining member.

DESCRIPTION OF THE PREFERRED EMBODIMENTS

Figure 1A:
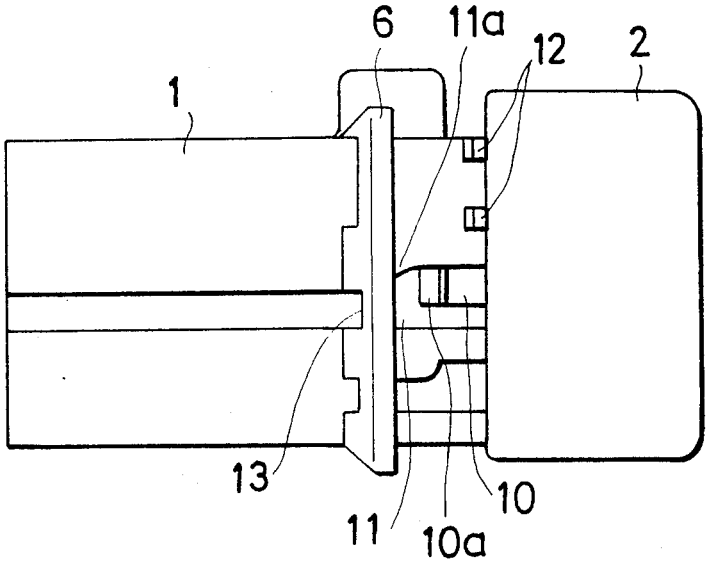
FIGS. 1A and 1B are side and perspective views, respectively showing an embodiment of the electric connector according to the invention.
Figure 1B:
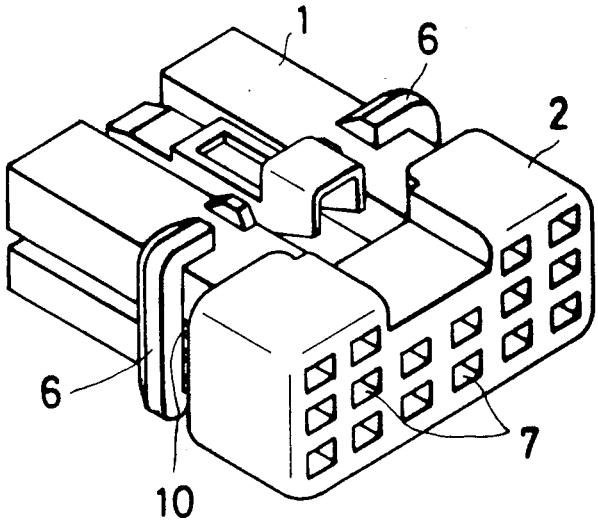

FIGS. 1 to 4 show a first embodiment of the electric connector according to the invention. The electric connector comprises a housing 1 and a terminal retaining member 2 both made of electrically insulating synthetic resin. In the housing 1 there are formed a plurality of cavities 3 for receiving a plurality of terminals 15 having electric wires 14 connected thereto. The cavities 3 are arranged in matrix having three rows. In each cavity 3 there is formed a pawl 4 for retaining a terminal within the cavity 3 as will be explained later. At a front end of the cavity 3 there is formed a frame-like member 5 which will be engaged with a front end of the terminal. Around an outer surface of the housing 1, there is formed a flange 6 which will be brought into contact with a front edge of the terminal retaining member 2. A rear portion of the housing 1 has generally a rectangular cross sectional shape and is inserted into an opening having a corresponding shape and formed in a front portion of the terminal retaining member 2. In a rear portion of the terminal retaining member 2 there are formed a plurality of holes 7 arranged in matrix corresponding to the cavities 3 formed in the housing 1. An inner surface 8 of the front portion of the terminal retaining member 2 serves as a guide for receiving the rear portion of the housing 1.

Figure 2:
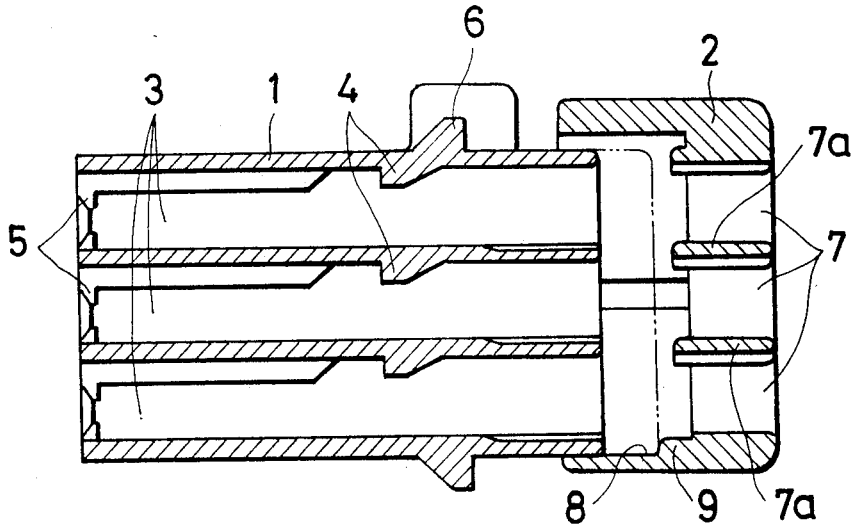
FIGS. 2, 3 and 4 are cross sectional views illustrating a manner of assembling the electric connector shown in FIGS. 1A and 1B.
Figure 3:
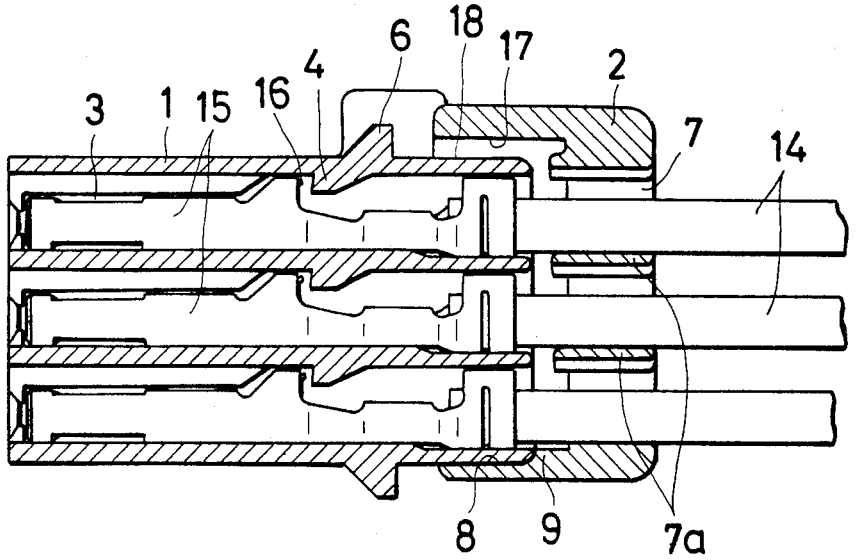

In the inner surface 8 of the terminal retaining member 2 there is formed a step 9. When the housing 1 is inserted into the terminal retaining member 2, the rear edge of the housing 1 is engaged with the step 9 as illustrated in FIG. 2 by a chain line so as to attain a first coupling between the housing 1 and the terminal retaining member 2. In the first coupling mode, the holes 7 formed in the terminal retaining member 2 are aligned with the cavities 3 formed in the housing 1. Thus terminals 15 having electric wires 14 connected thereto can be inserted into the cavities 3 through the holes 7.

At front ends of side walls of the terminal retaining member 2 there are formed locking arms. In the drawings there is shown only one locking arm 10. In the first coupling mode, the housing 1 and terminal retaining member 2 are preliminarily coupled with each other. As shown in FIG. 1A the locking arm 10 is inserted in a guide groove 11 formed in the outer surface of the rear portion of the housing 1. On the outer surface of the rear portion of the housing 1 there are further provided projections 12 and corresponding recesses are formed in the inner surface of the front portion of the terminal retaining member 2. In the first coupling condition the projections 12 are inserted into the recesses.

When a terminal 15 is inserted into a cavity 3 of the housing 1, a resilient locking tongue 16 formed in the terminal 15 is shifted downward below the retaining pawl 4 and then is returned into the initial position. Then the engagement between the terminal 15 and the pawl 4 is established and the terminal is prevented from being removed out of the cavity 3. It should be noted that the front end of the terminal 15 is engaged with the frame-like member 5 of the housing 1 so that the terminal 15 does not protrude from the front end of the housing 1.

Figure 4:
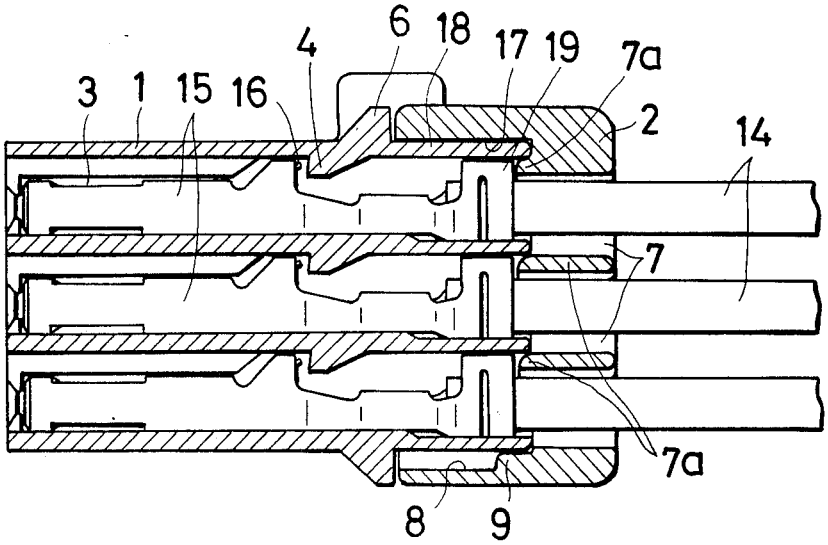

After a given number of terminals 15 have been inserted into the cavities 3 of the housing 1, the terminal retaining member 2 is moved, while a pawl 10*a* of the locking arm 10 is moved along the guide groove 11 until an upper wall 18 of the rear portion of the housing 1 is brought into contact with an inner surface 17 of the front portion of the terminal retaining member 2. Then the terminal retaining member 2 is moved forward until the front edge of the terminal retaining member 2 is urged against the flange 6 of the housing 1 as shown in FIG. 4. In this manner the housing 1 and terminal retaining member 2 are firmly coupled with each other in a second coupling mode. During this operation the pawl 10a of the locking arm 10 is passed through a hole formed in the flange 6 and is engaged with a locking edge 13 thereof. At the same time, a rear end portion of a wire clamping part 19 of the terminal 15 is engaged with a front edge 7*a* of the partition defining the holes 7, so that the terminals 15 are prevented from being removed out of the cavities 3 of the housing 1. In order to attain the retaining function in a positive manner, it is preferable to widen outwardly the wire clamping part 19 of the terminal 15.

Figure 5:
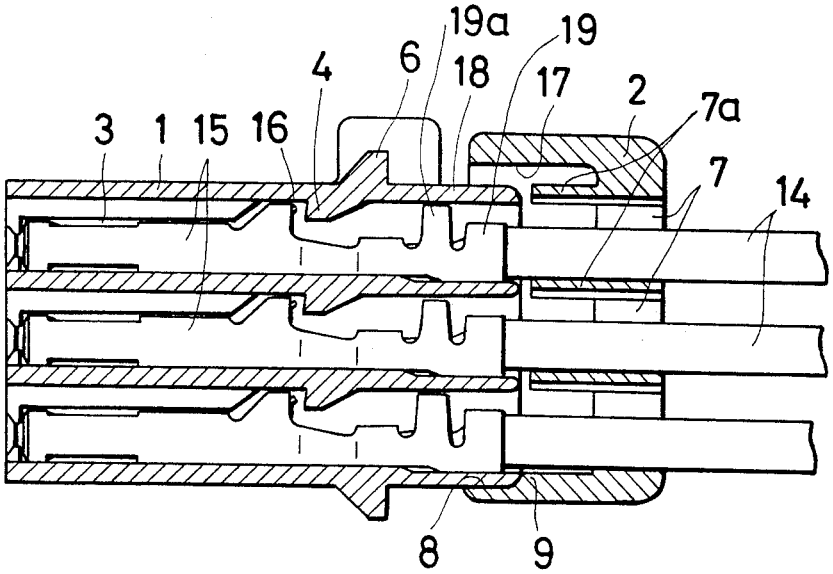
FIG. 5 is a cross sectional view depicting another embodiment of the electric connector according to the invention.

FIG. 5 is a cross sectional view illustrating a second embodiment of the electric connector according to the invention. In the first embodiment explained above, rear end portion of the wire clamping part 19 of the terminal 15 serves to retain the terminal within the cavity 3. In the present embodiment, near the wire clamping part 19 of the terminal 15 there is integrally formed a retaining projection 19*a* which is engaged with the edge 7*a* of the partition defining the holes 7. In the second coupling mode, the terminal 15 can be prevented from being removed out of the cavity 3 due to the engagement between the projection 19*a* and the edge 7*a*. In the present embodiment, since the wire clamping part 19 is not necessarily brought into contact with the edge 7*a*, a height of the wire clamping part 19 can be lowered.

Figure 6:
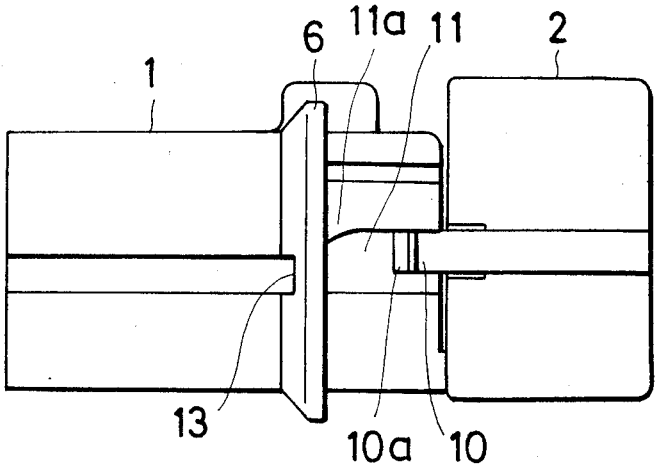
FIGS. 6 and 7 are side view and cross sectional view, respectively showing another embodiment of the electric connector according to the invention.
Figure 7:
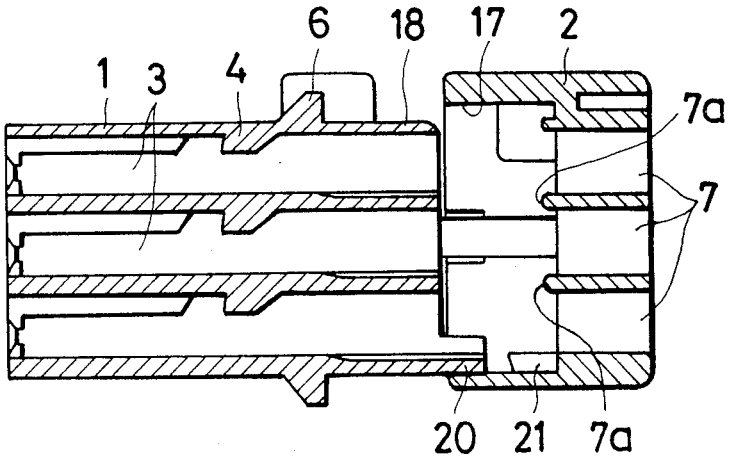

FIGS. 6 and 7 illustrate a third embodiment of the electric connector according to the invention. In the present embodiment, a plurality of projections 20 in the form of a flat plate are integrally formed with a lower side of the rear portion of the housing 1.

When the housing 1 is inserted into the terminal retaining member 2 so as to attain the first coupling mode, the projections 20 are inserted into corresponding dovetail recesses 21 formed in the terminal retaining member 2. In this manner the housing 1 and terminal retaining member 2 can be much more firmly coupled with each other, so that a number of terminals can be inserted into the cavities 3 through the holes 7 much more easily and positively. When the terminals are inserted into the cavities 3, a first retaining function is attained by the engagement between the projection of the terminal and the retaining pawl 4 of the housing 1. Then the engagement between the projections 20 and the dovetail grooves 21 is released and the terminal retaining member 2 is moved downward with respect to the housing 1 so that the outer surface 18 of the rear portion of the housing 1 is brought into contact with the inner surface 17 of the front portion of the terminal retaining member 2. Then the housing 1 is further inserted into the terminal retaining member 2, while the pawl 10*a* of the locking arm 10 is moved along the guide groove 11 until the front portion of the terminal retaining member 2 is brought into contact with the flange 6 formed on the outer surface of the housing and the pawl 10*a* is engaged with the locking edge 13 of the flange 6. In this second coupling mode, the terminal 15 is prevented from being removed out of the cavity 3 by the engagement with the front edge 7*a* of the partition defining the holes 7 of the terminal retaining member 2.

Figure 8:
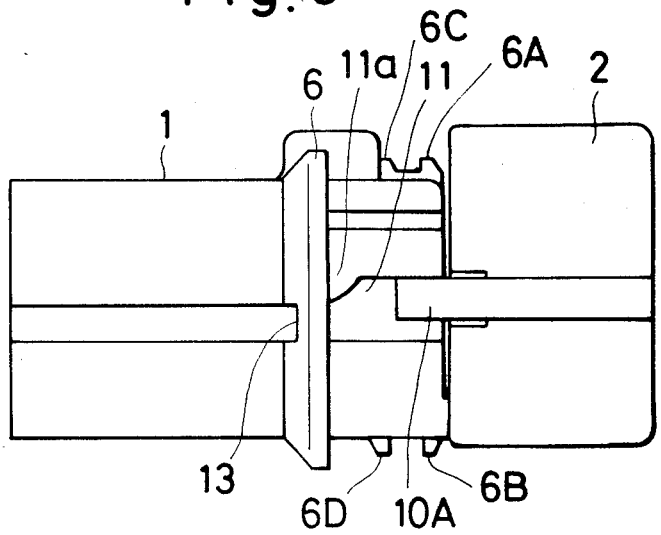
FIGS. 8 and 9 are side and cross sectional views, respectively illustrating another embodiment of the electric connector according to the invention.
Figure 9:
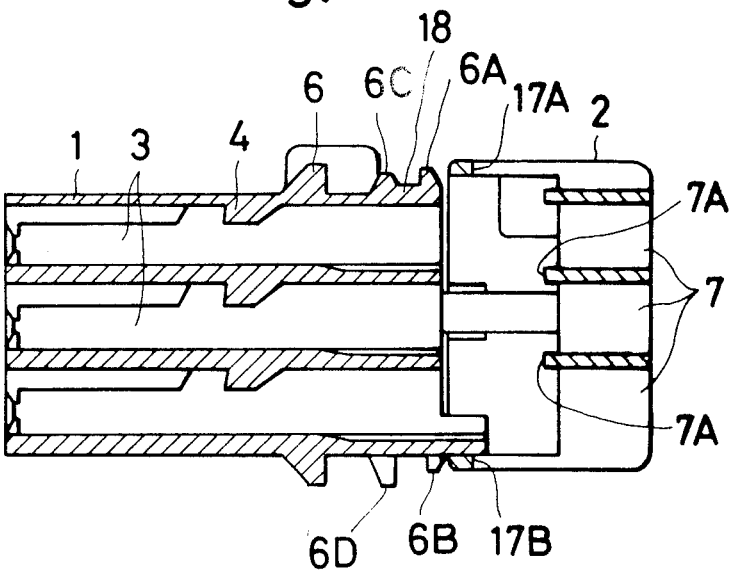
Figure 10:
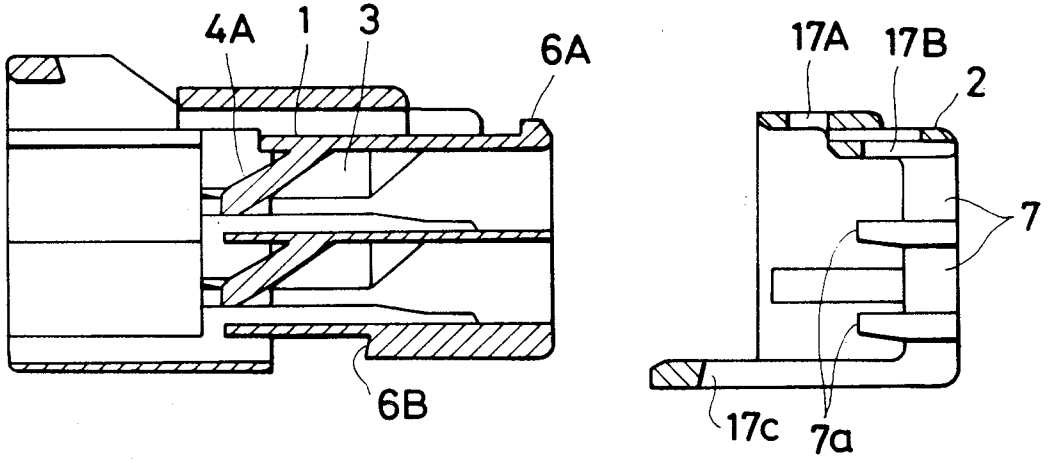
FIGS. 10, 11, 12 and 13 are cross sectional views showing a manner of assembling another embodiment of the electric connector according to the invention.

FIGS. 8 and 9 are side and cross sectional views, respectively showing a fourth embodiment of the electric connector according to the invention. In the present embodiment the locking arm 10 of the embodiment shown in FIG. 6 is replaced by a guide projection 10A without any pawl. On the outer surface 18 of the rear portion of the housing there are formed a plurality of projections 6A, 6B, 6C and 6D. In the front portion of the terminal retaining member 2 there are formed a plurality of holes 17A and 17B which engage with the projections 6A, 6B, 6C and 6D. In the first coupling mode the rear portion of the housing 1 is inserted into the front portion of the terminal retaining member 2 to such an extent that the projections 6A and 6B are inserted into the holes 17A and 17B. In this coupling mode, the edge portions 7*a* of the partitions defining the holes 7 are aligned with the partitions defining the cavities 3 of the housing 1. Then the terminals having the electric wires connected thereto are inserted into the cavities 3 through the holes 7. Next the housing 1 is further inserted into the terminal retaining member 2 to such an extent that the projections 6C and 6D are engaged with the holes 17A and 17B. During this inserting operation the terminal retaining member 2 moves downward due to the inclined guide recess 11A. The insertion of the housing 1 into the terminal retaining member 2 is limited by the engagement between the front edge of the terminal retaining member 2 and the flange 6.

After a given number of terminals having electric wires connected thereto have been inserted into the cavities 3, the terminal retaining member 2 is further moved toward the housing 1. Then the front edges of the upper and lower walls of the front portion of the terminal retaining member 2 are passed over the projections 6C and 6D, so that the projections 6C and 6D are inserted into the holes 17A and 17B of the terminal retaining member 2. In this manner the housing 1 and terminal retaining member 2 can be coupled with each other firmly in the second coupling mode.

In the present embodiment, in the first coupling mode, since the holes 17A and 17B formed in the upper and lower walls of the terminal retaining member 2 are engaged with the projections 6A and 6B formed on the upper and lower walls of the housing 1, the housing and terminal retaining member 2 can be firmly coupled with each other, and thus the terminals can be inserted into the cavities 3 in an easy and positive manner.

FIGS. 10 to 13 are cross sectional views showing a manner of assembling the housing and terminal retaining member of a fifth embodiment of the electric connector according to the invention. In the present embodiment, the housing 1 comprises locking arms 4A formed in the cavities 3 in the form of inclined rods. On the outer surface of the rear portion of the housing 1 there are formed projections, in the drawings one of which is shown by a reference numeral 6A. In a bottom wall of the housing 1 there is formed a step 6B. In upper and lower walls of the terminal retaining member 2 there are formed holes 17A, 17B and 17C.

Figure 11:
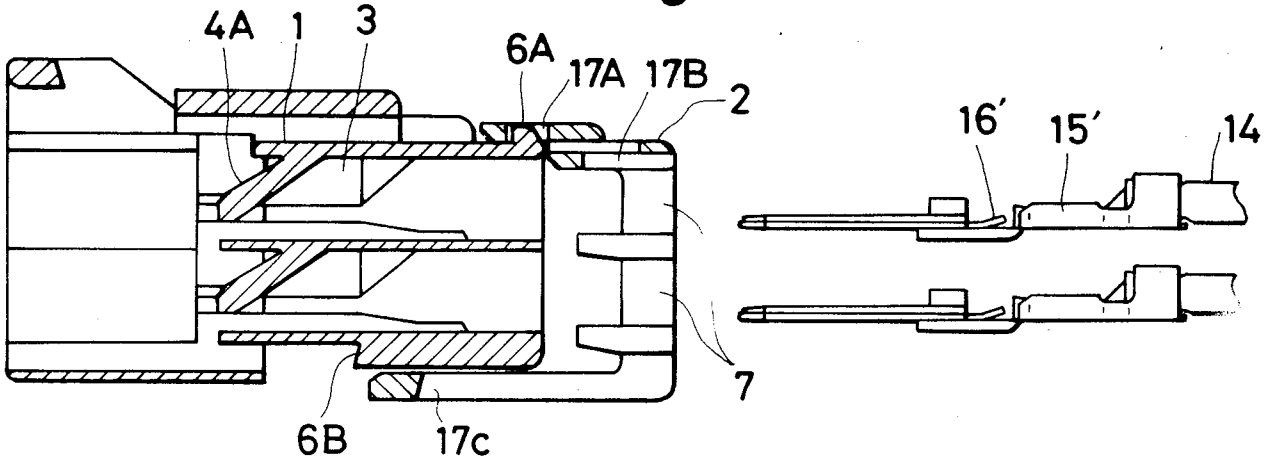
Figure 12:
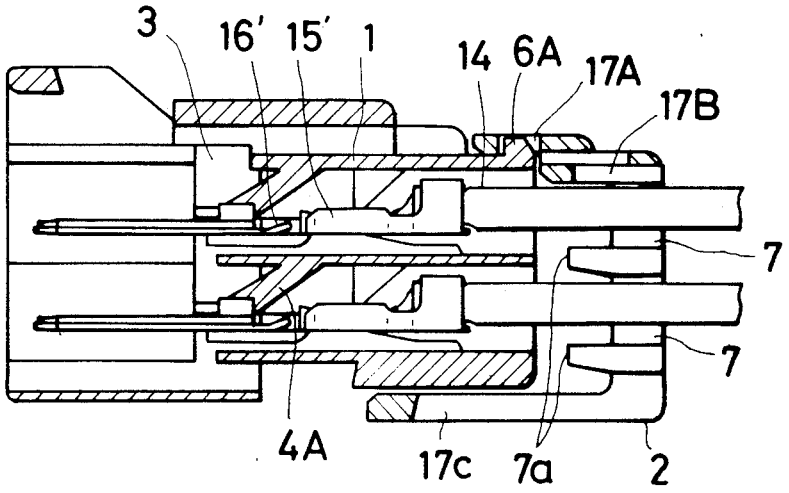

At first the rear portion of the housing 1 is inserted into the opening formed in the front portion of the terminal retaining member 2 as illustrated in FIG. 11, and the projection 6A is inserted into the hole 17A. In this first coupling mode the holes 7 of the terminal retaining member 2 are aligned with the cavities 3 of the housing 1 so that the terminals 15′ having electric wires 14 connected thereto can be easily inserted into the cavities through the holes. When the terminal 15′ has been inserted into the cavity 3 as shown in FIG. 12 the projection 16′ of the terminal 15′ is passed over the tip of locking arm 4A and thus the terminal can be retained within the cavity 3 due to the engagement between the projection 16′ and the locking arm 4A.

Figure 13:
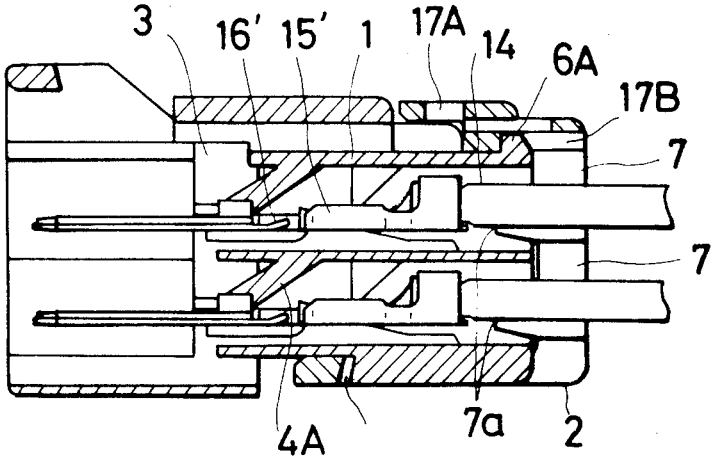
Figure 14:
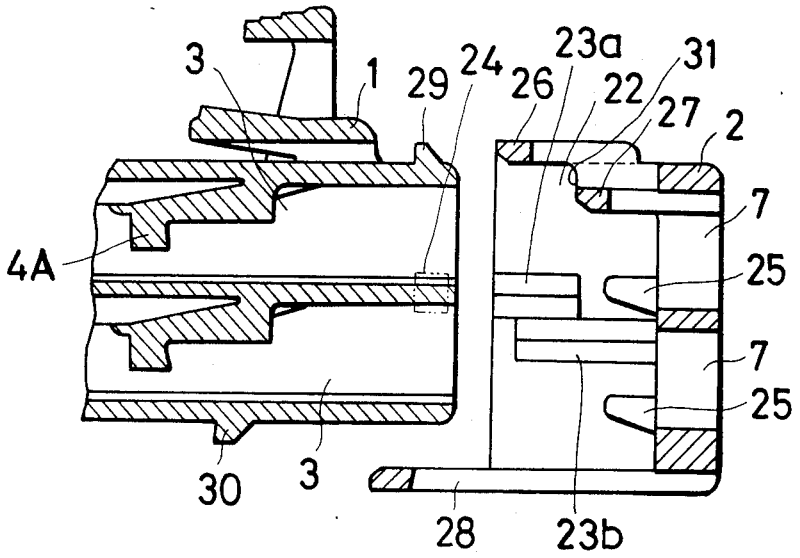
FIGS. 14, 15, 16 and 17 are cross sectional views illustrating still another embodiment of the electric connector according to the invention.

Then the terminal retaining member 2 is further moved toward the housing 1 and the projection 6A is inserted into the hole 17B and the step 6B is inserted into the hole 17C as illustrated in FIG. 13. During this movement, the terminal retaining member 2 is shifted upward with respect to the housing 1 and the front edge 7*a* of the partition defining the holes 7 of the terminal reteining member 2 has come into such a position that the edge 7*a* is engaged with the rear portion of the terminal 15′ so that the terminal could not be removed from the cavity 3.

FIGS. 14 to 17 are cross sectional views showing a sixth embodiment of the electric connector according to the invention. In the present embodiment, in inner surfaces 22 of respective side walls of the terminal retaining member 2, there are formed a pair of grooves 23*a* and 23*b* each having a triangular cross section. On outer surfaces of corresponding side walls of the housing 1, there are formed guide projections 24 each having a triangular cross section corresponding to that of the grooves 23*a* and 23*b*. On the side walls defining defining respective holes 7, there are formed retaining projections 25. In the terminal retaining member 2 there are further formed locking arms 26, 27 and 28, and in the housing 1 there are provided a pawl 29 engaging with the locking arms 26, 27 and a pawl 30 engaging with the locking arm 28.

Figure 15:
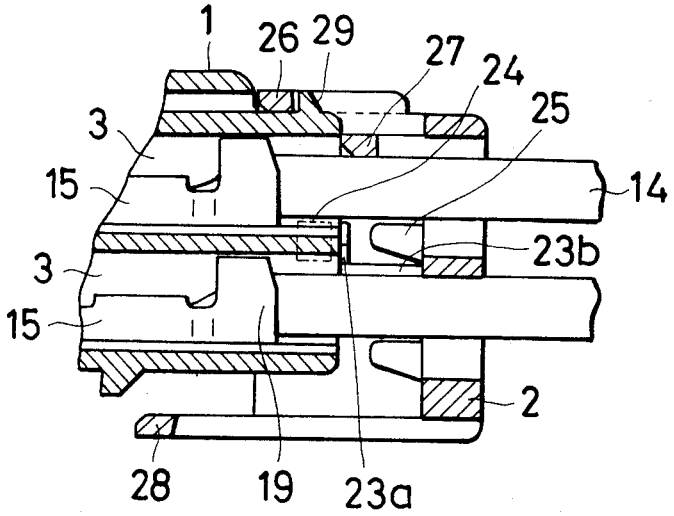

At first the housing 1 is inserted into the terminal retaining member 2, while the guide projections 24 are inserted in the grooves 23*a* as illustrated in FIG. 15 until an inner edge portion 31 of the terminal retaining member 2 is brought into contact with the rear end of the housing 1. Then the locking arm 26 is engaged with the pawl 29 to attain the preliminary engagement between the housing 1 and the terminal retaining member 2. In this engagement, the cavities 3 in the housing 1 are aligned with the holes 7 in the terminal retaining member 2, so that terminals 15 having electric wires connected thereto can be inserted into the cavities 3 through the holes 7 in an easy manner.

Figure 16:
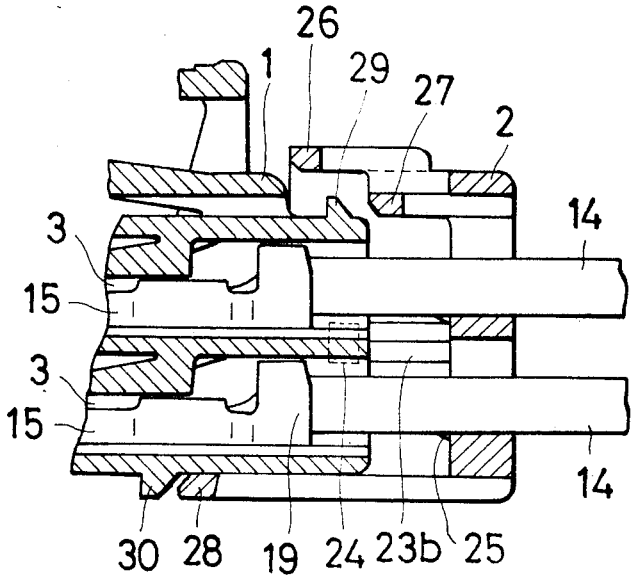

After a given number of terminals 15 have been inserted into the cavities 3, when the terminal retaining member 2 is moved upward relative to the housing 1, the guide projections 24 are removed from the grooves 23*a* and are slipped into the groove 23*b* as shown in FIG. 16. At the same time, the engagement between the locking arm 26 and the pawl 29 is released and the locking arm 28 is brought into contact with the bottom surface of the housing 1.

Figure 17:
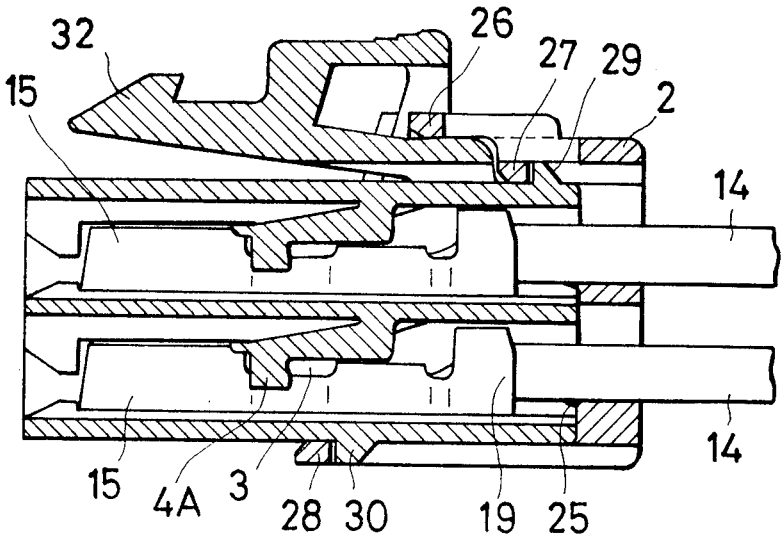

Next, the terminal retaining member 2 is moved toward the housing 1 and the locking arms 27 and 28 are engaged with the pawls 29 and 30, respectively as illustrated in FIG. 17. In this manner, the housing 1 and the terminal retaining member 2 are firmly coupled with each other. In this engagement, front ends of the retaining projections 25 formed on the terminal retaining member 2 are positioned to face the rear end surfaces of the terminals 15 to attain the second retaining function. It should be noted that the first retaining function can be performed by the engagement between the locking arm 4A and the terminal 15 as shown in FIG. 17. Further a locking arm 32 provided on the housing 1 serves to couple the electric connector with another device not shown in a detachable manner.

As explained above in detail in the electric connector according to the invention, the terminals having electric wires connected thereto can be easily inserted by one operation into the cavities formed in the housing through the holes formed in the terminal retaining member, while the housing and the terminal retaining member are preliminarily coupled with each other. When the housing and terminal retaining member are moved relative to each other, they are firmly coupled with each other. At the same time, the terminal retaining member can effectively prevent the terminals from being removed out of the cavities in the housing. Therefore, according to the invention, the electric connector can be assembled simply and easily and the number of operation steps can be reduced substantially. It should be noted that the terminals may be arranged in the housing in the form of matrix having more than two rows, or may be arranged in a zigzag manner.

What is claimed is:

1. An electric connector comprising a housing comprised of an electrically insulating material and having at least one cavity for receiving a terminal having an electric wire connected thereto and at least one retaining portion formed on an inner surface of the cavity;

a terminal retaining member comprised of an electrically insulating material and having at least one hole through which said terminal can be passed;

a first coupling means for coupling said housing and terminal retaining member with each other in a first coupling mode in which said at least one hole of the terminal retaining member is aligned with said at least one cavity of the housing thus permitting the terminal having the electric wire connected thereto to be inserted into the cavity through the hole, said retaining portion being engaged with a portion of the terminal in said first coupling mode and a second coupling means for coupling the housing and terminal retaining member with each other in a second coupling mode in which the entire terminal retaining member is shifted with respect to the housing at least in a direction perpendicular to a direction in which the terminal is inserted into the cavity, thus preventing the removal of said terminal from the cavity as a result of engagement between the terminal and a portion of the terminal retaining member.

2. An electric connector according to claim 1, wherein said first and second coupling means are so constructed that the terminal retaining member is moved in the direction perpendicular to the terminal inserting direction to release the first coupling mode and the terminal retaining member is moved further toward the housing in the terminal inserting direction to attain the second coupling mode.

3. An electric connector according to claim 1, wherein said first and second coupling means are so constructed that the terminal retaining member is moved in a direction inclined with respect to the terminal inserting direction to release the first coupling mode and attain the second coupling mode.

4. An electric connector according to claim 1, wherein said terminal retaining member comprises at least one projection formed therein, said projection being cooperatively engaged with a rear portion of the terminal in the second coupling mode.

5. An electric connector according to claim 4, wherein said projection of the terminal retaining member is cooperatively engaged with a rear end of the terminal in the second coupling mode.

6. An electric connector according to claim 1, wherein said terminal retaining member has an opening formed in a front portion thereof, the cross sectional shape of said opening substantially corresponding to an outer configuration of the rear portion of the housing, whereby the rear portion of the housing may be inserted into the opening in the front portion of the terminal retaining member.

7. An electric connector according to claim 6, wherein said first coupling means comprises at least one projection formed on an outer surface of the rear portion of the housing, and at least one hole formed in the front portion of the terminal retaining member, with said projection being cooperatively engaged with said hole in the first coupling mode.

8. An electric connector according to claim 6, wherein said first coupling means comprises at least one hole formed in the rear portion of the housing, and at least one projection formed on an outer surface of the front portion of the terminal retaining member, whereby said projection is engaged with said hole in the first coupling mode.

9. An electric connector according to claim 6, wherein said second coupling means comprises at least one projection formed in the rear portion of the housing, and at least one hole formed in the front portion of the terminal retaining member, whereby said projection is cooperatively engaged with said hole in the second coupling mode.

10. An electric connector according to claim 6, wherein said second coupling means comprises at least one projection formed on an outer surface of the rear portion of the housing, and at least one hole formed in the front portion of the terminal retaining member, whereby said projection is cooperatively engaged with said hole in the second coupling mode.

11. An electric connector according to any one of claims 7 to 10, wherein said first coupling means comprises at least one guide groove formed in the outer surface of the rear portion of the housing and at least one locking arm formed on the outer surface of the front portion of the terminal retaining member, said locking arm being inserted and moved in said groove.

12. An electric connector according to claim 11, wherein said second coupling means comprises at least one guide groove formed in the outer surface of the rear portion of the housing and communicating with said guide groove of the first coupling means by means of an intermediate guide groove formed in the outer surface of the rear portion of the housing and inclined with respect to the direction in which the terminal is inserted into the cavity.

13. An electric connector according to claim 12, wherein said second coupling means further comprises a pawl formed at a free end of the locking arm and a locking edge formed in the outer surface of the housing, said pawl being engaged with said locking edge in the second coupling mode.

* * * * *